United States Patent [19]

Busch et al.

[11] Patent Number: 4,958,647

[45] Date of Patent: Sep. 25, 1990

[54] APPLICATOR FOR CONTINUOUS APPLICATION OF HAIR DYE

[75] Inventors: Peter Busch, Erkrath; Klaus Thiele, Langenfeld, both of Fed. Rep. of Germany

[73] Assignee: Henkel Kommanditgesellschaft auf Aktien, Duesseldorf-Holthausen, Fed. Rep. of Germany

[21] Appl. No.: 307,440

[22] Filed: Feb. 7, 1989

[30] Foreign Application Priority Data

Feb. 8, 1988 [DE] Fed. Rep. of Germany ..... 3803692

[51] Int. Cl.[5] ..... A45D 24/42

[52] U.S. Cl. ..... 132/119.1; 132/108

[58] Field of Search ..... 132/112, 113, 114, 115, 132/116, 119.1, 108; 401/283

[56] References Cited

U.S. PATENT DOCUMENTS

| | | | |
|---|---|---|---|
| 1,515,525 | 11/1924 | Stevens | 132/114 |
| 1,570,013 | 1/1926 | Smith | 132/114 |
| 2,299,296 | 10/1942 | Battle | 132/108 |
| 2,596,296 | 5/1952 | Shields | 132/112 |
| 2,603,223 | 7/1952 | Jefferson | 132/108 |
| 2,922,425 | 1/1960 | Lerner et al. | 132/112 |
| 3,059,652 | 10/1962 | Thomas | 132/112 |
| 3,262,459 | 7/1966 | Sheehan | 132/108 |
| 3,721,250 | 3/1973 | Walter et al. | 132/112 |
| 3,861,407 | 1/1975 | Gabriele | 132/108 |
| 3,964,501 | 6/1976 | Matchett | 132/112 |
| 4,376,441 | 3/1983 | Duncan | 132/112 |
| 4,585,018 | 4/1986 | O'Connor | 132/120 |

FOREIGN PATENT DOCUMENTS

| | | | |
|---|---|---|---|
| 43519 | 1/1982 | European Pat. Off. | 132/112 |
| 168741 | 1/1986 | European Pat. Off. | 132/112 |
| 251189 | 1/1988 | European Pat. Off. | 132/112 |
| 2163878 | 6/1973 | Fed. Rep. of Germany | 132/112 |

*Primary Examiner*—John Weiss
*Assistant Examiner*—M. Lynch
*Attorney, Agent, or Firm*—Ernest G. Szoke; Wayne C. Jaeschke

[57] ABSTRACT

An applicator for the continuous application of a hair dye to the head hair of human beings, comprises a reservoir for hair dye absorbed in a first absorbent material within a tubular element, and teeth of a second absorbent material inserted into the element in a manner not contacting the first absorbent material, whereby for the transfer of the hair dye from the first absorbent material to the teeth not in contact therewith, the reservoir is connected to a rotation mechanism.

6 Claims, 1 Drawing Sheet

APPLICATOR FOR CONTINUOUS APPLICATION OF HAIR DYE

BACKGROUND 1.0 Field of the Invention:

This invention relates generally to hair dye applicators, and more particularly to applicators for the continuous application of a hair dye to head hair of human beings either directly or indirectly from a reservoir for the hair dye.

2.0 Discussion of Related Art:

A comb for the continuous application of a liquid to the hair and scalp of animals or human beings is known (see EP 0 157 032). The comb comprises a hollow space in which a first absorbent material is accommodated to take up and store the liquid. A plurality of teeth of a second absorbent material, which project into the first absorbent material through openings in the hollow space, are in capillary communication with the first absorbent material holding the liquid in the hollow space. In this manner, the liquid can be applied to both the hair, and to the skin through the tips and side faces of the teeth. This comb is particularly suitable for the treatment of animals with insecticides or the like.

In the treatment of head hair of human beings with hair-cosmetic preparations, such as hair dyes and the like, the main object is to uniformly apply the treatment preparation to the hair in accordance with the particular length and thickness thereof, to ensure uniform dyeing of every hair. However, it has been found that the comb described in EP 0 157 032 does not satisfy these requirements and that hair cannot be uniformly dyed with this comb.

3.0 Summary of the Invention:

An object of the present invention is to provide an improved applicator with which the quantity of treatment preparation applied can be controlled in accordance with the length and thickness of the hair of the person being treated, and to further provide for the complete emptying of the treatment preparation from its storage reservoir.

In one embodiment of the invention, an improved applicator comprises a reservoir for hair dye including a first absorbent material within a tubular element and teeth of a second absorbent material inserted into the element for transfer of the hair dye from the reservoir to the teeth not in contact therewith, the reservoir being connected to a rotational mechanism. This arrangement ensures that the teeth are always adequately supplied with hair dye by the reservoir. The treatment volume is precisely controlled through control of the speed of rotation. Compared with a known capillary-active connection, which is only guaranteed when the teeth are in complete contact with the stored material, the teeth of the present invention are completely independently arranged separate from the stored material, and the hair dye is expelled from the reservoir solely by centrifugal force and projected against the teeth or rather the inner wall of the tubular element. In addition, the rotational movement provides for complete emptying of the stored material.

In a preferred embodiment of the invention, the rotation mechanism is formed by a motor, a gear and a reservoir holder. The actual rotational movement is produced by the motor and can be converted into the required speed via a gear mechanism.

In another embodiment, the motor is equipped with an electronic circuit. The rotational speed and hence the volume of liquid expelled from the reservoir can be precisely controlled through this electronic circuit, for insuring the exact amount of hair dye required is always expelled from the teeth.

In still another embodiment, the applicator is made particularly easy to handle by arranging the rotation mechanism in a housing adjoining the tubular element.

In yet another embodiment of the invention, the reservoir is formed by a plurality of individual reservoirs of the first absorbent material arranged outside the axis of rotation. In this manner, a larger amount of liquid is able to issue from the reservoirs compared with a single reservoir during the rotational movement.

In another practical embodiment of the invention, an annular seal is arranged between the tubular element and the reservoir holder. This seal ensures that no liquid hair dye is able to penetrate into the housing of the rotation mechanism.

BRIEF DESCRIPTION OF THE DRAWINGS

The invention is described by way of example in the following with reference to the accompanying drawings, in which like items are identified by the same reference number, wherein.

DETAILED DESCRIPTION OF THE INVENTION

Figures 1, 2:
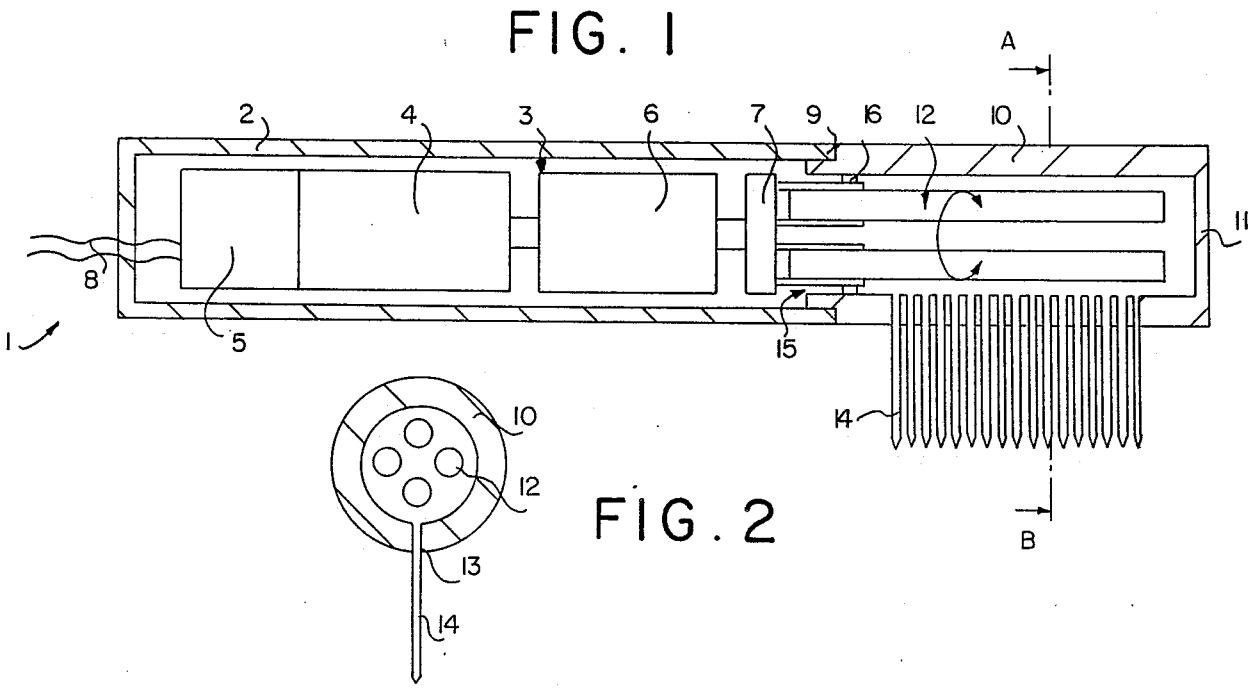
FIG. 1 is a longitudinal section through one example of an embodiment of the invention.
FIG. 2 is a sectional view through the embodiment of FIG. 1 on the line A - B.

FIG. 1 shows an applicator 1 comprising a housing 2 for a rotation mechanism 3. The rotation mechanism 3 consists of a motor 4 with an electronic circuit 5, a gear assembly 6, and a reservoir holder 7 arranged at the gear exit. The motor 4 and the electronic circuit 5 are provided with a power supply line 8, which exits from the housing 2. Arranged at the open end 9 of the housing 2 is a tubular element 10 of which the outer surface is flush with the outer surface of the housing 2. The free end 11 of the tubular element 10 is closed.

Arranged in the tubular element 10 are four individual reservoirs 12 of a first absorbent material which form the reservoir for liquid hair dyes, and which open into the reservoir holder 7. Teeth 14 of a second absorbent material are inserted into openings 13 of the tubular element 10 perpendicularly of the orientation of the individual reservoirs 12. An annular seal 16, around the individual reservoirs 12, is inserted into the tubular element 10 in a region 15 between the tubular element 10 and the reservoir holder 7.

Before the hair dyeing process is started, the individual reservoirs 12 of the first absorbent material are completely filled with liquid hair dye. In order to dye a person's head hair, the rotation mechanism 3 of the applicator 1 is switched on to initiate rotation of the individual reservoirs 12. The liquid hair dye is expelled from the individual reservoirs 12 by centrifugal force and projected against the inner wall of the tubular element 10. The hair dye runs down the inner wall and enters the wick-like teeth 14 situated in the housing openings 13. The teeth 14 arranged in the manner of a comb serve to transfer the hair dye to the head hair. To this end, the teeth 14 are drawn through the hair so that the liquid hair dye is transferred to the hair through the side faces of the teeth 14.

To prevent the liquid hair dye expelled from the individual reservoirs 12 from entering the housing 2 of the rotation mechanism 3, the seal 16 is arranged in the region 15 between the tubular element 10 and the reservoir holder 7.

The speed of rotation is controlled through the electronic circuit 5 of the motor 4. The rotational speed of the motor 4 is adjusted in accordance with the amount of hair dye required in the teeth 14. Thus, if the individual reservoirs 12 rotate too quickly, too much hair dye is expelled and cannot be transferred by the teeth 14. By subsequently reducing the rotational speed, release from the individual reservoirs 12 is prevented so that the hair dye present in excess in the tubular element 10 is then transferred via the teeth 14.

The invention is not limited to the example of embodiment illustrated in the drawing. Further embodiments of the invention are possible without departing from the basic concept, which embodiments are meant to be covered by the spirit and scope of the appended claims.

What is claimed is:

1. An applicator for the continuous application of a hair dye to the head hair of human beings comprises a tubular element containing a first absorbent material serving as a reservoir hair dye, and teeth of a second absorbent material inserted into said tubular element in a non-contacting manner with said first absorbent material, wherein for the transfer of the hair dye from the reservoir to the teeth, the reservoir is connected to a rotation mechanism.

2. An applicator as claimed in claim 1, wherein said rotation mechanism includes a motor, a gear driven by said motor, and a reservoir holder rotated via said gear.

3. An applicator as claimed in claim 2, further including an electronic circuit for controlling the speed of said motor.

4. An applicator as claimed in claim 1, further including said rotation mechanism arranged in a housing adjoining said tubular element.

5. An applicator as claimed in claim 1, wherein said reservoir includes a plurality of individual reservoirs formed from said first absorbent material, respectively, arranged outside the axis of rotation.

6. An applicator as claimed in claim 1, further including an annular seal arranged between said tubular element and said reservoir holder.

* * * * *